US009946184B2

(12) United States Patent
Yuasa et al.

(10) Patent No.: US 9,946,184 B2
(45) Date of Patent: Apr. 17, 2018

(54) IMAGE FORMING APPARATUS USING FLAT TONER TO OBTAIN A GLOSS

(71) Applicant: FUJI XEROX CO., LTD., Minato-ku, Tokyo (JP)

(72) Inventors: Koichiro Yuasa, Kanagawa (JP); Miho Ikeda, Kanagawa (JP); Takaharu Nakajima, Kanagawa (JP); Aya Kakishima, Kanagawa (JP); Yasumitsu Harashima, Kanagawa (JP); Toko Hara, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 27 days.

(21) Appl. No.: 14/487,188

(22) Filed: Sep. 16, 2014

(65) Prior Publication Data

US 2015/0227076 A1 Aug. 13, 2015

(30) Foreign Application Priority Data

Feb. 7, 2014 (JP) ..... 2014-022311

(51) Int. Cl.
*G03G 15/01* (2006.01)
*G03G 15/00* (2006.01)

(52) U.S. Cl.
CPC ..... *G03G 15/0131* (2013.01); *G03G 15/0178* (2013.01); *G03G 15/6585* (2013.01); *G03G 15/0189* (2013.01)

(58) Field of Classification Search
CPC ..... G03G 9/0825; G03G 9/0827
USPC ..... 399/223, 82, 231; 430/107.1, 110.1, 430/110.3
See application file for complete search history.

(56) References Cited

U.S. PATENT DOCUMENTS

2002/0106574 A1* 8/2002 Haneda ..... G03G 9/0827 430/124.1
2003/0152852 A1* 8/2003 Shigeta ..... G03G 9/0827 430/45.54
2004/0037573 A1 2/2004 Hirota et al.
2004/0057753 A1* 3/2004 Choi et al. ..... 399/228
(Continued)

FOREIGN PATENT DOCUMENTS

JP 07160077 A * 6/1995
JP 2004 77931 A 3/2004
(Continued)

OTHER PUBLICATIONS

Communication dated Nov. 11, 2014 from the Japanese Patent Office in counterpart application No. 2014-022311.

*Primary Examiner* — Erika J Villaluna
(74) *Attorney, Agent, or Firm* — Sughrue Mion, PLLC

(57) ABSTRACT

An image forming apparatus includes a first image forming portion that uses toner containing flat pigment; a second image forming portion that uses toner not containing the flat pigment; and a toner image carrier that carries a first toner image that is formed in the first image forming portion and a second toner image that is formed in the second image forming portion. The image forming apparatus has a mode in which a relationship Am<Ac is satisfied, where Am denotes a number of toner layers of the first toner image that is carried by the toner image carrier, and Ac denotes the number of toner layers of the second toner image that is carried by the toner image carrier.

14 Claims, 10 Drawing Sheets

(56) References Cited

U.S. PATENT DOCUMENTS

| | | | | |
|---|---|---|---|---|
| 2011/0318682 | A1* | 12/2011 | Takahashi | G03G 9/0819 430/105 |
| 2014/0023964 | A1 | 1/2014 | Hirai et al. | |
| 2014/0043625 | A1* | 2/2014 | Koyatsu | G06K 15/18 358/1.9 |

FOREIGN PATENT DOCUMENTS

| | | | |
|---|---|---|---|
| JP | 2005 140994 | A | 6/2005 |
| JP | 2006-317632 | A | 11/2006 |
| JP | 2006-317633 | A | 11/2006 |
| JP | 2014 21300 | A | 2/2014 |

* cited by examiner $$FI = \frac{2.69 \times (L^*_{15^\circ} - L^*_{110^\circ})^{1.11}}{L^*_{45^\circ}{}^{0.86}}$$

IMAGE FORMING APPARATUS USING FLAT TONER TO OBTAIN A GLOSS

CROSS-REFERENCE TO RELATED APPLICATIONS

This application is based on and claims priority under 35 USC 119 from Japanese Patent Application No. 2014-022311 filed Feb. 7, 2014.

BACKGROUND

Technical Field

The present invention relates to an image forming apparatus.

Summary

According to an aspect of the invention, there is provided an image forming apparatus including a first image forming portion that uses toner containing flat pigment; a second image forming portion that uses toner not containing the flat pigment; and a toner image carrier that carries a first toner image that is formed in the first image forming portion and a second toner image that is formed in the second image forming portion. The image forming apparatus has a mode in which a relationship Am<Ac is satisfied, where Am denotes a number of toner layers of the first toner image that is carried by the toner image carrier, and Ac denotes the number of toner layers of the second toner image that is carried by the toner image carrier.

BRIEF DESCRIPTION OF THE DRAWINGS

Exemplary embodiment of the present invention will be described in detail based on the following figures, wherein.

DETAILED DESCRIPTION

An exemplary embodiment of the present invention will be described below with reference to the drawings. First, the overall configuration and operation of an image forming apparatus will be described. Then, the relevant part of this exemplary embodiment will be described. Note that, in the following description, the "apparatus height direction" is a direction indicated by an arrow H in FIG. 1, the "apparatus width direction" is a direction indicated by an arrow W in FIG. 1. The direction perpendicular to both apparatus height direction and apparatus width direction is the "apparatus depth direction", which is indicated by an arrow D.

Overall Configuration of Image Forming Apparatus

Figure 1:
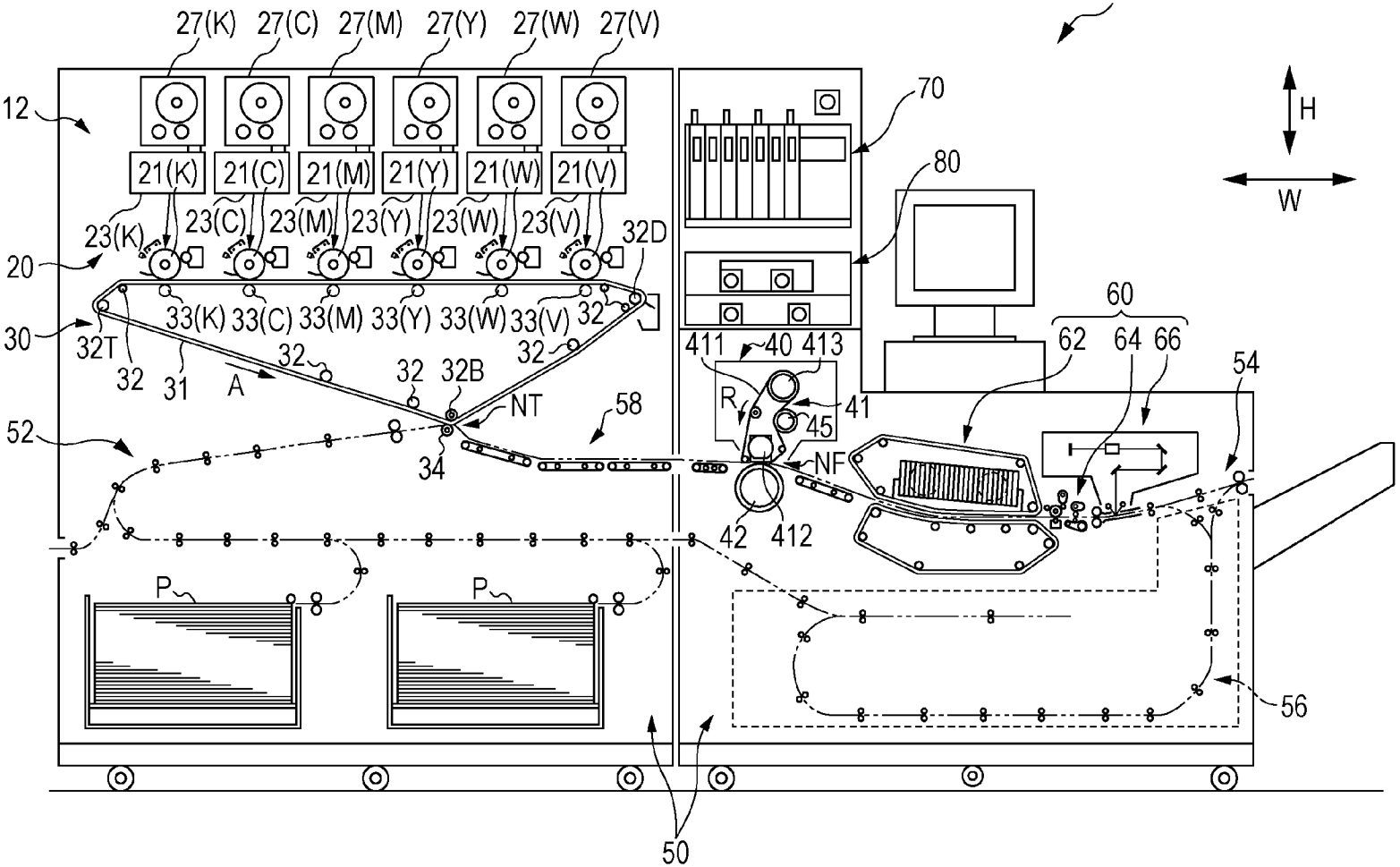
FIG. 1 is a schematic view showing the overall configuration of an image forming apparatus according to this exemplary embodiment.

FIG. 1 is a schematic front view showing the overall configuration of an image forming apparatus 10 according to this exemplary embodiment. As shown in FIG. 1, the image forming apparatus 10 includes an image forming section 12 that forms an image on a sheet member P, serving as an example of a recording medium, using a electrophotographic system; a media transport portion 50 that transports the sheet member P; and a post-processing section 60 that performs post-processing on the sheet member P on which the image has been formed. The image forming apparatus 10 further includes a controller 70 and a power supply unit 80. The controller 70 controls the power supply unit 80 and the aforementioned sections and portions. The power supply unit 80 supplies power to the aforementioned sections and portions, including the controller 70.

Configuration of Image Forming Section

Figure 2:
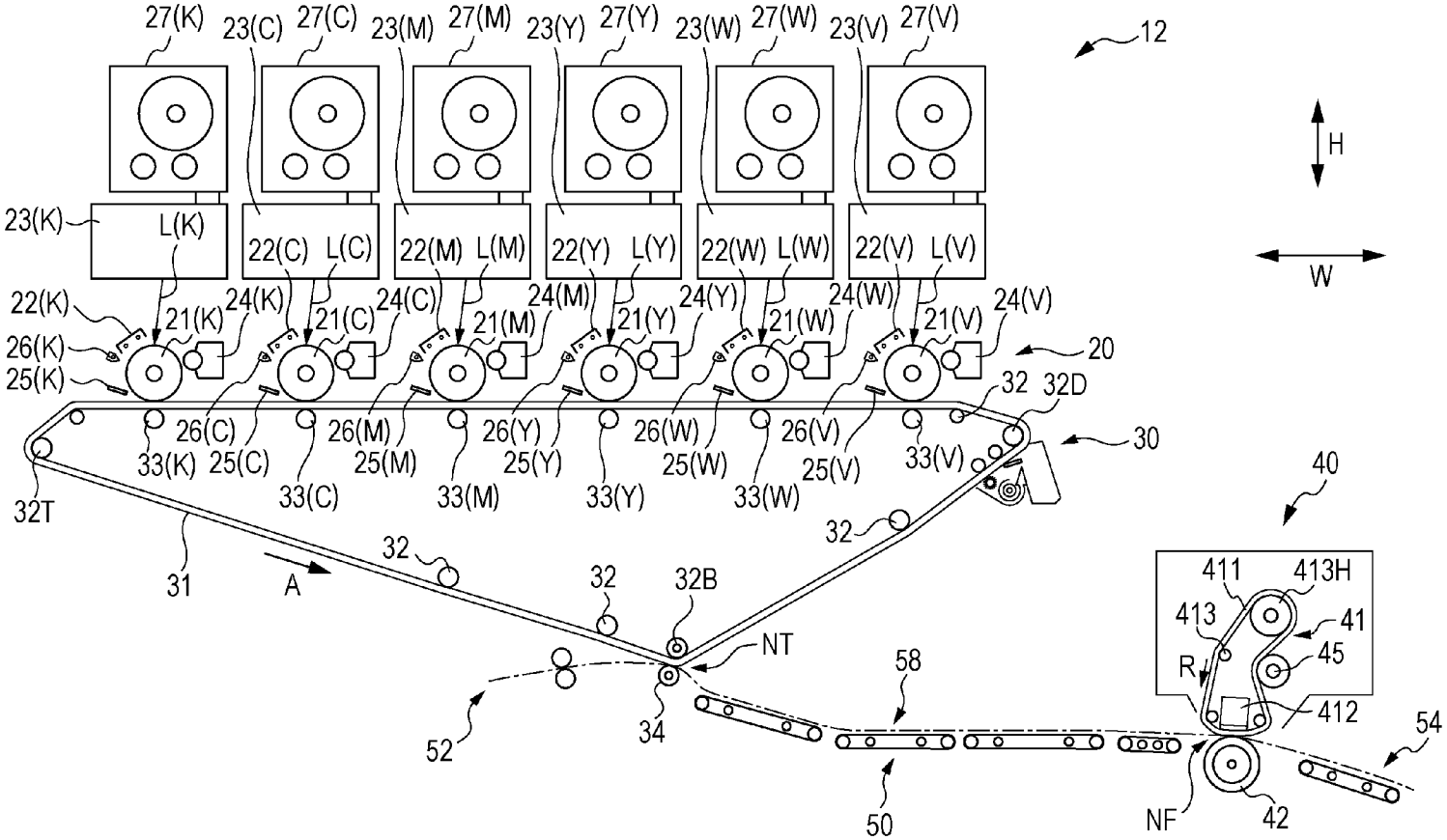
FIG. 2 is a schematic view showing the configuration of an image forming section that constitutes an image forming unit according to this exemplary embodiment.

Referring to FIG. 2, which schematically shows the image forming section 12 as viewed from the front, the image forming section 12 will be described. The image forming section 12 includes photoconductor drums 21, serving as an example of a latent image carrier; chargers 22; exposure devices 23; developing devices 24; cleaning devices 25; toner-image forming portions 20 (see also FIG. 3) that form toner images; a transfer device 30 that transfers the toner images formed by the toner-image forming portions 20 to a sheet member P; and a fixing device 40 that fixes the toner image transferred to the sheet member P.

The toner-image forming portions 20 are provided so as to form toner images of the respective colors. In this exemplary embodiment, six toner-image forming portions 20, corresponding to the first special color (V), the second special color (W), yellow (Y), magenta (M), cyan (C), and black (K), are provided. The letters (V), (W), (Y), (M), (C), and (K) suffixed to the reference numerals used in FIGS. 1 and 2 indicate the above-mentioned colors. The transfer device 30 transfers toner images of these six colors, first-transferred in a superposed manner to a transfer belt 31, serving as an example of a toner image carrier, to a sheet member P at a transfer nip NT.

In this exemplary embodiment, the first special color (V) is a metallic color that is used to add metallic shine to an image, whereas the second special color (W) is a corporate color specific to a user, which is more frequently used than the other colors. Toners of the respective colors will be described below.

Photoconductor Drum

Figure 3:
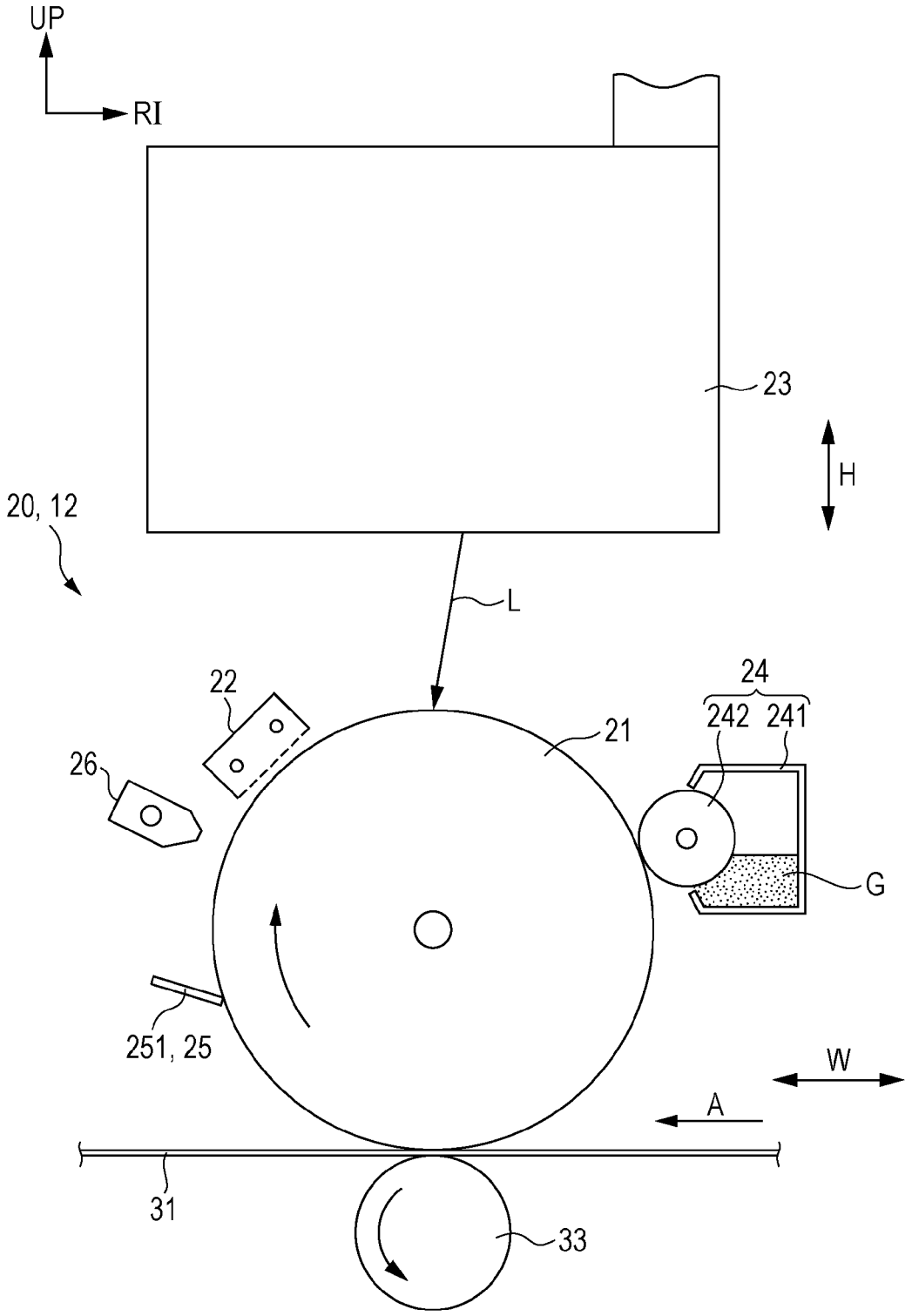
FIG. 3 is a schematic view showing the configuration of a toner-image forming portion that constitutes the image forming unit according to this exemplary embodiment.

As shown in FIGS. 2 and 3, the photoconductor drums 21 are cylindrical and configured to be rotated about their own shafts by driving devices (not shown). The photoconductor drums 21 have, for example, a negatively charged photosensitive layer on the outer circumferential surfaces thereof. The photoconductor drums 21 may also have an overcoat layer on the outer circumferential surfaces thereof. These photoconductor drums 21 corresponding to the respective colors are arranged in a straight line in the apparatus width direction, as viewed from the front.

Charger

The chargers 22 negatively charge the outer circumferential surfaces (photosensitive layers) of the photoconductor drums 21. In this exemplary embodiment, the chargers 22 are scorotron chargers of corona discharge type (non-contact type).

Exposure Device

The exposure devices 23 form electrostatic latent images on the outer circumferential surfaces of the photoconductor drums 21. More specifically, the exposure devices 23 radiate modulated exposure light L (see FIG. 3) to the outer circumferential surfaces of the photoconductor drums 21 that have been charged by the chargers 22, in accordance with image data received from an image-signal processing unit constituting the controller 70. Upon radiation of the exposure light L by the exposure devices 23, electrostatic latent images are formed on the outer circumferential surfaces of the photoconductor drums 21. In this exemplary embodiment, the exposure devices 23 expose the outer circumferential surfaces of the photoconductor drums 21 by scanning laser beams emitted from light sources across the surfaces of the photoconductor drums 21, using light-scanning devices (optical systems) each including a polygon mirror and an Fθ lens. In this exemplary embodiment, the exposure device 23 is provided for each color.

Developing Device

The developing devices 24 form toner images on the outer circumferential surfaces of the photoconductor drums 21 by developing, with developer G containing toner, the electrostatic latent images formed on the outer circumferential surfaces of the photoconductor drums 21. Although a detailed description will not be given here, the developing devices 24 each include, at least, a container 241 containing the developer G, and a developing roller 242 that supplies the developer G in the container 241 to the photoconductor drum 21 while rotating. Toner cartridges 27 are connected to the containers 241 via supply paths (not shown) for supplying the developer G. The toner cartridges 27 corresponding to the respective colors are arranged side-by-side in the apparatus width direction in front view, above the photoconductor drums 21 and the exposure devices 23, and independently replaceable.

Furthermore, a developing bias voltage is applied to the developing roller 242. The developing bias voltage is a voltage applied between the photoconductor drum 21 and the developing roller 242. By applying the developing bias voltage, an electric potential difference is caused between the developing roller 242 and the photoconductor drum 21, and, as a result, the electrostatic latent image on the photoconductor drum 21 is developed as a toner image.

Cleaning Device

The cleaning devices 25 each include a blade 251 for scraping off the toner remaining on the surface of the photoconductor drum 21 after the toner image has been transferred to the transfer device 30. Although not shown, the cleaning device 25 further includes a housing for storing the toner scraped off with the blade 251 (see FIG. 3), and a transport device for transporting the toner in the housing to a waste toner box.

Transfer Device

The transfer device 30 first-transfers the toner images formed on the respective photoconductor drums 21 to the transfer belt 31 in a superposed manner and second-transfers the superposed toner image to a sheet member P (see FIG. 2).

More specifically, as shown in FIG. 2, the transfer belt 31 has an endless structure and is wound around multiple rollers 32 so as to be held in a certain position. In this exemplary embodiment, the transfer belt 31 is held so as to form an inverted obtuse triangle shape elongated in the apparatus width direction in front view. Among the multiple rollers 32, a roller 32D shown in FIG. 2 serves as a driving roller that drives the transfer belt 31 in an arrow A direction by using a driving force of a motor (not shown). Furthermore, among the multiple rollers 32, a roller 32T shown in FIG. 2 serves as a tension roller that applies tension to the transfer belt 31. Among the multiple rollers 32, a roller 32B shown in FIG. 2 serves as an opposing roller for a second transfer roller 34.

The transfer belt 31 is in contact with the respective photoconductor drums 21 from below, at the upper side thereof extending in the apparatus width direction in the above-described position. The toner images formed on the respective photoconductor drums 21 are transferred to the transfer belt 31 when transfer bias voltages are applied from first transfer rollers 33. Furthermore, the lower obtuse apex of the transfer belt 31 is in contact with the second transfer roller 34, forming the transfer nip NT. When a transfer bias voltage from the second transfer roller 34 is applied, the transfer belt 31 transfers the toner image thereon to a sheet member P passing through the transfer nip NT.

Fixing Device

As shown in FIG. 2, the fixing device 40 fixes the toner image transferred to the sheet member P in the transfer device 30 onto the sheet member P.

The fixing device 40 fixes the toner image to the sheet member P by applying heat and pressure to the toner image at the fixing nip NF formed between a pressure roller 42 and a fixing belt 411 wound around multiple rollers 413. A roller 413H is a heating roller that has, for example, a built-in heater and is rotated by a driving force transmitted from a motor (not shown). With this configuration, the fixing belt 411 is rotated in an arrow R direction.

Media Transport Portion

The media transport portion 50 includes a media feeding unit 52 that feeds a sheet member P to the image forming section 12, and a media discharge unit 54 that discharges the sheet member P after an image is formed thereon. The media transport portion 50 further includes a media returning unit 56 that is used when images are formed on both sides of a sheet member P, and an intermediate transport portion 58 that transports a sheet member P from the transfer device 30 to the fixing device 40.

The media feeding unit 52 feeds sheet members P on a one-by-one basis to the transfer nip NT in the image forming section 12 in accordance with the timing of transfer. The media discharge unit 54 discharges a sheet member P, onto which a toner image is fixed in the fixing device 40, from the apparatus. When an image is to be formed on the other side of a sheet member P having a toner image fixed to one side thereof, the media returning unit 56 reverses the sheet member P and feeds it back to the image forming section 12 (media feeding unit 52).

Post-Processing Section

As shown in FIG. 1, the post-processing section 60 includes a media cooling unit 62 that cools a sheet member P on which an image has been formed in the image forming section 12, a straightening device 64 that straightens the curled sheet member P, and an image inspection portion 66 that inspects the image formed on the sheet member P. The components of the post-processing section 60 are disposed in the media discharge unit 54 of the media transport portion 50.

The media cooling unit 62, the straightening device 64, and the image inspection portion 66, which constitute the post-processing section 60, are arranged in the media discharge unit 54, in sequence from the upstream side in a sheet-discharge direction, and perform the above-described post-processing on the sheet member P that is being discharged by the media discharge unit 54.

Image Forming Operation

Next, the outline of the image forming and subsequent post-processing processes performed on a sheet member P by the image forming apparatus 10 will be described.

As shown in FIG. 1, upon receipt of an image forming instruction, the controller 70 activates the toner-image forming portions 20, the transfer device 30, and the fixing device 40. As a result, the photoconductor drums 21 and the developing rollers 242 are rotated, and the transfer belt 31 is driven. Furthermore, the pressure roller 42 is rotated, and the fixing belt 411 is driven. The controller 70 further activates the media transport portion 50 etc. in synchronization with the operation of these components.

As a result, the respective photoconductor drums 21 are charged by the chargers 22 while being rotated. Furthermore, the controller 70 sends image data processed in the image-signal processing unit to the respective exposure devices 23. The exposure devices 23 emit exposure light L in accordance with the image data to expose the corresponding charged photoconductor drums 21. As a result, electrostatic latent images are formed on the outer circumferential surfaces of the photoconductor drums 21. The electrostatic latent images formed on the respective photoconductor drums 21 are developed with developer supplied from the developing devices 24. In this way, toner images of the first special color (V), the second special color (W), yellow (Y), magenta (M), cyan (C), and black (K) are formed on the corresponding photoconductor drums 21.

The toner images of the respective colors formed on the corresponding photoconductor drums 21 are sequentially transferred to the running transfer belt 31, when subjected to transfer bias voltages through the corresponding first transfer rollers 33. In this way, a superposed toner image, in which toner images of six colors are superposed on one another, is formed on the transfer belt 31. The superposed toner image is transported to the transfer nip NT by the running transfer belt 31. The media feeding unit 52 feeds a sheet member P to the transfer nip NT, in accordance with the timing of the transportation of the superposed toner image. By applying a transfer bias voltage at the transfer nip NT, the superposed toner image is transferred from the transfer belt 31 to the sheet member P.

The sheet member P having the toner image transferred thereto is transported from the transfer nip NT in the transfer device 30 to the fixing nip NF in the fixing device 40 by the intermediate transport portion 58, while being subjected to negative-pressure suction. The fixing device 40 applies heat and pressure (fixing energy) to the sheet member P passing through the fixing nip NF. In this way, the toner image transferred to the sheet member P is fixed.

The sheet member P discharged from the fixing device 40 is processed by the post-processing section 60 while being transported to a discharged-media receiving portion outside the apparatus by the media discharge unit 54. The sheet member P heated in the fixing process is first cooled by the media cooling unit 62 and then straightened by the straightening device 64. The toner image fixed to the sheet member P is inspected for the presence/absence and level of toner density defect, image defect, image position defect, etc. by the image inspection portion 66. Finally, the sheet member P is discharged onto the media discharge unit 54.

When an image is to be formed also on a non-image surface (i.e., a surface having no image) of the sheet member P (that is, when two-sided printing is to be performed), the controller 70 switches the transportation path for the sheet member P having gone through the image inspection portion 66 from the media discharge unit 54 to the media returning unit 56. As a result, the sheet member P is reversed and fed to the media feeding unit 52. Then, an image is formed (fixed) on the back surface of the sheet member P through the same image forming process as that performed on the front surface of the sheet member P. The sheet member P then goes through the same post-processing process as that performed on the front surface of the sheet member P after the image formation and is discharged outside the apparatus by the media discharge unit 54.

Configuration of Relevant Part

Toner

Next, the toners used this exemplary embodiment will be described.

Figure 4A:
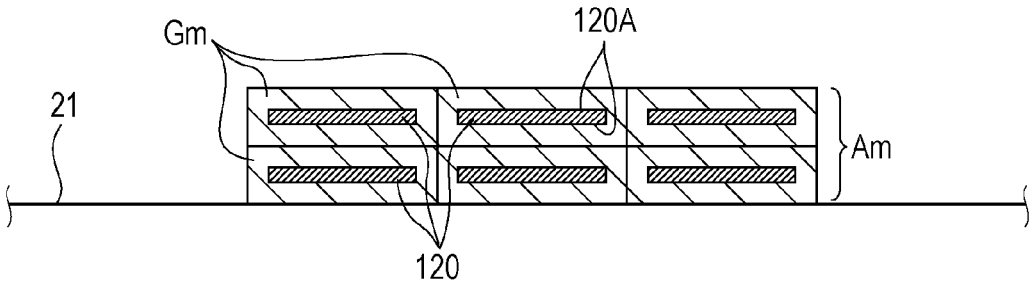
FIG. 4A is a diagram for explaining the number of layers of a metallic-color toner.

As shown in FIG. 4, the overall shape of a toner particle Gm of a metallic color (hereinbelow, a "metallic-color toner particle Gm"), which is used as the first special color (V) and contains a flat pigment particle 120, is a flat disc shape. The metallic-color toner particle Gm is composed of a binder resin, such as styrene-acrylic resin, and the flake-like flat pigment particle 120, a charge control agent (not shown), etc. internally added thereto. In FIG. 4A, the metallic-color toner particles Gm are schematically illustrated in a rectangular shape so that they may be easily distinguished from other-color toner particles Gc described below.

The flat pigment particle 120 according to this exemplary embodiment is composed of flake-like flat aluminum. More specifically, when viewed from a side, the flat pigment particle 120 disposed on a flat surface has a flat shape that is larger in the left-right direction than in the top-bottom direction. Furthermore, the flat pigment particle 120 has a pair of reflection surfaces (flat surfaces) 120A facing up and down in FIG. 4A.

By reflecting light at the reflection surfaces 120A of the flat pigment particles 120 contained in the metallic-color toner particles Gm, the metallic shine is added to an image formed with the metallic-color toner particles Gm.

Figure 4B:
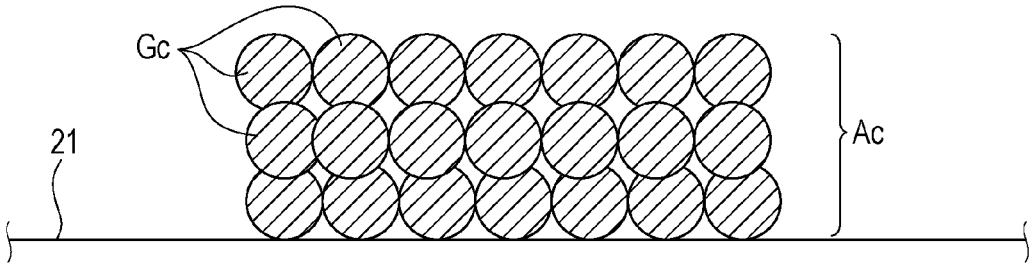
FIG. 4B is a diagram for explaining the number of layers of another-color toner.

As shown in FIG. 4B, the toner particles Gc of the colors other than the metallic color (hereinbelow, "the other-color toner particles Gc"), which are used as the second special color (W), yellow (Y), magenta (M), cyan (C), and black (K) and do not contain the flat pigment particles 120 (see FIG. 4A), have an odd shape such as substantially sphere or potato shape. The other-color toner particles Gc are each composed of a binder resin, such as styrene-acrylic resin, and a pigment other than the flat pigment, a charge control agent, etc. (not shown) internally added thereto. Note that, although the other-color toner particles Gc are schematically illustrated as having a ball shape in side view in FIG. 4B, they have, in actuality, as described above, an odd shape such as substantially sphere or potato shape (see FIG. 12).

Note that the other-color toner particles Gc do not necessarily have to have an odd shape such as substantially sphere or potato shape, but may have an odd shape like a ground toner.

First Relevant Part Configuration

A first relevant part configuration will be described.

A toner image formed with the metallic-color toner particles Gm is formed on the photoconductor drum 21 of the toner-image forming portion 20V corresponding to the first special color (V (metallic color)). On the other hand, toner images formed with the other-color toner particles Gc are formed on the photoconductor drums 21W, 21Y, 21M, 21C, and 21K of the toner-image forming portions 20W, 20Y, 20M, 20C, and 20K corresponding to the second special color (W), yellow (Y), magenta (M), cyan (C), and black (K), other than the first special color (V). The toner images on the respective photoconductor drums 21 are first transferred to the transfer belt 31 by the transfer device 30.

The image forming apparatus 10 has a mode that satisfies Am<Ac, where Am denotes the number of toner layers of a toner image formed with the metallic-color toner particles Gm transferred to the transfer belt 31, as shown in FIG. 4A, and Ac denotes the number of toner layers of a toner image formed with the other-color toner particles Gc transferred to the transfer belt 31, as shown in FIG. 4B.

Moreover, in this exemplary embodiment, the number of toner layers, Am, in a toner image formed with the metallic-color toner particles Gm is set to a value close to one.

The numbers of toner layers, Am and Ac, on the transfer belt 31 are set so as to satisfy the relationship Am<Ac by adjusting the mass per unit area of toner in the toner images on the photoconductor drums 21 by changing the intensity of the exposure light L emitted from the exposure devices 23 shown in FIG. 3, the electric potential of the developing bias to be applied to the developing rollers 242 of the developing devices 24, and the charge amount of toner (charging properties). Note that the relationship Am<Ac may be satisfied on the photoconductor drums 21.

Furthermore, the numbers of toner layers, Am and Ac, are set so as to satisfy the relationship Am<Ac when the percentage of image area in electrostatic latent images on the photoconductor drums 21 is 100%. In addition, even when the percentage of image area in the electrostatic latent images on the photoconductor drums 21 is less than 100%, if the percentages of image area in the metallic-color toner particles Gm and in the other-color toner particles Gc are the same, the numbers of toner layers, Am and Ac, are set so as to satisfy the relationship Am<Ac. Note that the percentage of image area is the percentage of the area occupied by a toner image.

Furthermore, the numbers of toner layers, Am and Ac, per unit area in a toner image when the percentage of image area is 100% may be defined by (m/mt)/(1/S), where m is the mass per unit area of toner, mt is the average mass per toner particle, and S is the average projection area per toner particle.

Note that the average projection area S per toner particle may be obtained from the area of a circle ($\pi r^2$), when the shape of the toner is analogous to a ball or disc shape and when the center particle diameter of the toner is 2r. The center particle diameter of the toner, 2r, may be measured using a charge amount distribution measuring apparatus (E-SPART ANALYZER) manufactured by Hosokawa Micron Corporation, Multisizer manufactured by Beckman Coulter, Inc., or the like.

Alternatively, the numbers of toner layers, Am and Ac, may be known by taking out and observing, with a microscope, the transfer belt 31 or photoconductor drum 21 carrying the toner image.

Operation

Next, the operation of the first relevant part configuration will be described.

When an image forming instruction to give metallic shine to at least a portion of an image is issued (in a mode in which the metallic shine is given to at least a portion of an image), as shown in FIG. 1, the toner-image forming portion 20V corresponding to the metallic color (i.e., an example of a first image forming portion) is activated.

More specifically, an electrostatic latent image corresponding to a portion where the metallic shine is given to an image is formed on the surface of the photoconductor drum 21V. That is, when the metallic shine is to be given to the entire image, the electrostatic latent image is formed on the entire surface of the photoconductor drum 21V, whereas when the metallic shine is to be given to a portion of the image, an electrostatic latent image corresponding to that portion is formed.

The electrostatic latent image formed on the photoconductor drum 21V is developed with the developer containing the metallic-color toner particles Gm (see FIG. 5, etc.), supplied from the developing device 24V. In this way, a metallic-color toner image is formed on the photoconductor drum 21V.

This metallic-color toner image is transferred to the running transfer belt 31, and subsequently, the other-color toner images are sequentially transferred to the transfer belt 31. In this way, a superposed toner image, in which toner images of six colors are superposed on one another, is formed on the transfer belt 31. This superposed toner image is transferred from the transfer belt 31 to a sheet member P at the transfer nip NT.

The sheet member P having the toner image transferred thereto is transported from the transfer nip NT in the transfer device 30 to the fixing nip NF in the fixing device 40 by the intermediate transport portion 58. The fixing device 40 applies heat and pressure to the sheet member P passing through the fixing nip NF. In this way, the toner image transferred to the sheet member P is fixed.

Figure 5:
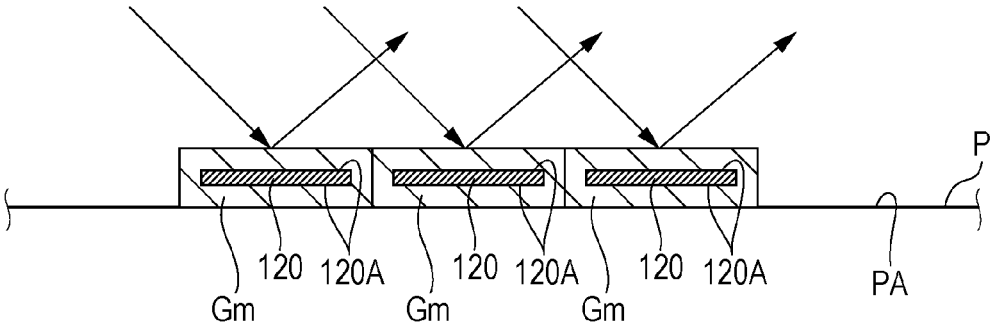
FIG. 5 is a schematic diagram showing that the number of metallic-color toner layers is small and that reflection surfaces of flat pigment particles have an ideal orientation in which they are arrayed parallel to the plane of the sheet member without overlapping one another.
Figure 6:
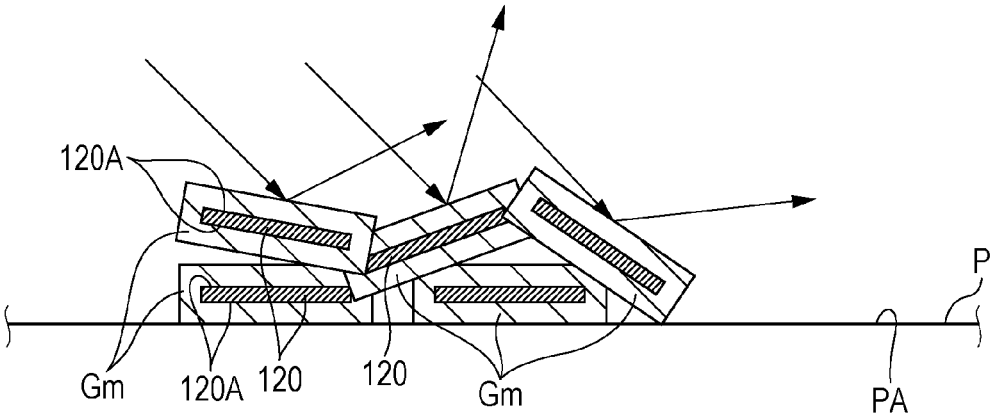
FIG. 6 is a schematic diagram showing that the number of the metallic-color toner layers is large and that the reflection surfaces of the flat pigment particles are in an orientation in which they randomly face directions intersecting a direction parallel to the plane of the sheet member.

Herein, the relationship between the metallic shine (i.e., the dependence of reflectance on angle) given by the metallic-color toner particles Gm and the number of toner layers will be described. FIGS. 5 and 6 schematically show toner images formed with the metallic-color toner particles Gm, fixed to a sheet member P. Although the binder resin portions contained in the toner particles are fused together in actuality, they are illustrated in a separate manner in FIGS. 5 and 6 for ease of understanding. Furthermore, the other-color toner particles Gc are not shown.

Figure 7:
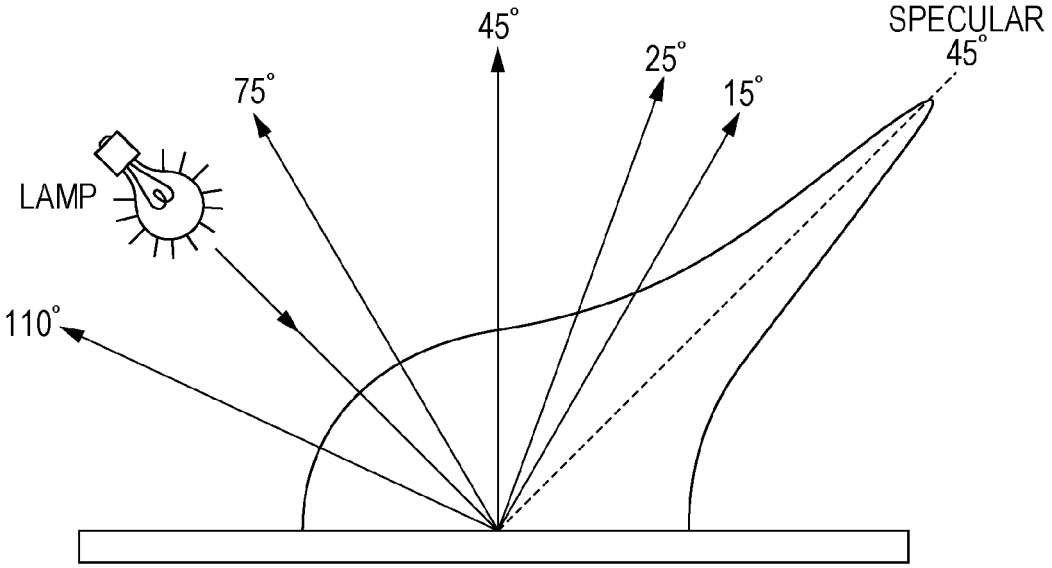
FIG. 7 is an expression for calculating the flop index (FI)
Figure 8:
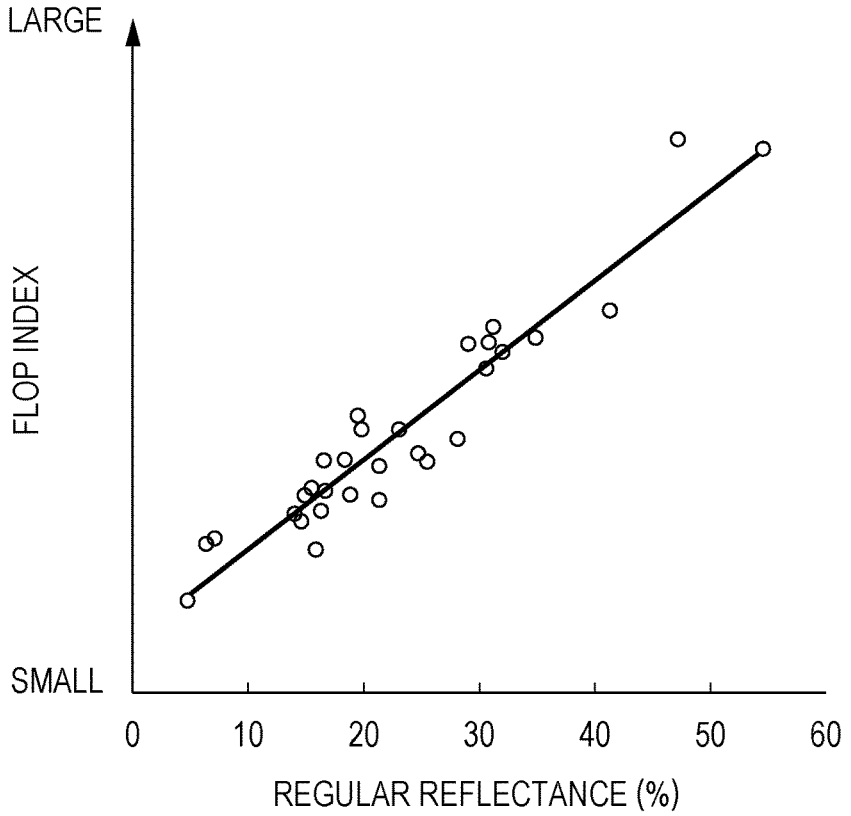
FIG. 8 is a graph showing FI versus regular reflectance.

In order to enhance the metallic shine achieved by the metallic-color toner particles Gm, it is necessary to increase the flop index (FI) shown in FIG. 7; that is, it is necessary to increase the regular reflectance ($L^*_{15°}$) and decrease the diffuse reflectance ($L^*_{110°}$). This is understood from the fact that, as shown in FIG. 8, FI increases as the regular reflectance increases.

More specifically, as shown in FIG. 5, when the number of layers, Am, of the metallic-color toner particles Gm is small and, moreover, close to one, the orientation characteristics of the toner particles are high. Hence, the reflection surfaces 120A of the flat pigment particles 120 are likely to have an ideal orientation in which they are arrayed parallel to a plane PA of the sheet member P without overlapping one another. Due to the reflection surfaces 120A of the flat pigment particles 120 having this ideal orientation in which they are arrayed parallel to the plane PA of the sheet member P without overlapping one another, light is reflected in the same direction, increasing the regular reflectance ($L^*_{15°}$) and decreasing the diffuse reflectance ($L^*_{110°}$), and consequently, enhancing the metallic shine (increasing FI).

However, as shown in FIG. 6, when the number of layers, Am, of the metallic-color toner particles Gm is large, the orientation characteristics of the toner particles are low. Hence, the reflection surfaces 120A of the flat pigment particles 120 are likely to have an orientation in which they face various directions intersecting a direction parallel to the plane PA of the sheet member P while overlapping one another. Due to the reflection surfaces 120A of the flat pigment particles 120 facing various directions intersecting a direction parallel to the plane PA of the sheet member P while overlapping one another, light is reflected in random directions, reducing the regular reflectance ($L^*_{15°}$) and increasing the diffuse reflectance ($L^*_{110°}$), and consequently, decreasing the metallic shine (decreasing FI).

In this exemplary embodiment, the relationship between Am and Ac (Am denotes the number of toner layers of a toner image formed with the metallic-color toner particles Gm on the transfer belt 31, and Ac denotes the number of toner layers of a toner image formed with the other-color toner particles Gc on the transfer belt 31) is set to be Am<Ac. Hence, compared with a case where the relationship between Am and Ac is Am≥Ac, the reflection surfaces 120A of the flat pigment particles 120 are likely to have an ideal orientation in which they are arrayed, in a single layer, along a direction parallel to the plane PA of the sheet member P, as shown in FIG. 5, thus increasing the regular reflectance ($L^*_{15°}$) and decreasing the diffuse reflectance ($L^*_{110°}$), and consequently, enhancing the metallic shine.

Furthermore, because the number of toner layers, Am, in a toner image formed with the metallic-color toner particles Gm is set to a value close to one, the ideal orientation shown in FIG. 5 is more likely to be achieved.

This will be described from a different perspective; that is, the metallic shine is enhanced by controlling the numbers of toner layers, Am and Ac, such that they satisfy the relationship Am<Ac, so that the flat pigment particles 120 contained in the metallic-color toner particles Gm have the ideal orientation shown in FIG. 5.

Furthermore, it is set such that Am<Ac is satisfied when the percentages of image areas in electrostatic latent images on the photoconductor drums 21 formed with the metallic-color toner particles Gm and the other-color toner particles Gc are the same. Hence, compared with a case where Am<Ac is not satisfied, the regular reflectance ($L^*_{15°}$) is maintained to be high. In other words, change in metallic shine is suppressed even when the gradation (the intensity in shade of an image) changes.

Figure 9:
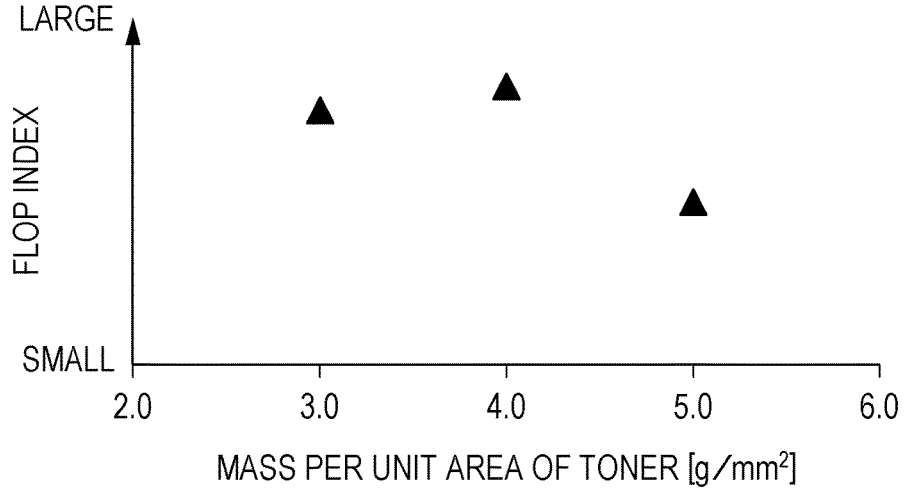
FIG. 9 is a graph showing FI versus mass per unit area of the metallic-color toner.

FIG. 9 is a graph showing FI versus mass per unit area of the metallic-color toner particles Gm on a sheet member P before fixing. As shown in the graph, FI is highest when the mass per unit area of toner is at around 4.0 g/mm$^2$, and FI is low when the mass per unit area of toner is at 5.0 g/mm$^2$. As described above, because the number of toner layers is defined by (m/mt)/(1/S), the number of toner layers, Am, increases as the mass, m, per unit area of toner increases. Hence, FI decreases as the number of toner layers, Am, increases.

Although any method may be employed to measure the mass, m, per unit area of toner in a toner image on a sheet member P, an example of the measuring method will be described below.

First, a filled-in patch image (image area: 100%) of 20 mm×50 mm is output and transferred to a sheet member P. Then, toner particles of an unfixed toner image of the filled-in patch image are vacuumed using a removable vacuum head connected to a vacuum machine.

The vacuumed toner is collected by a filter, and the mass, M, of the collected toner is measured.

Then, by dividing the mass, M, of the collected toner by the area (20 mm×50 mm), the mass, m, per unit area of toner in the toner image on the sheet member P is calculated.

Second Relevant Part Configuration

Next, a second relevant part configuration will be described. Note that a description the same as that for the first relevant part configuration will be omitted.

The image forming apparatus 10 has a mode that satisfies Bm>Bc, where Bm denotes the gloss (shine level) of an image formed on the sheet member P with the metallic-color toner particles Gm and fixed in the fixing device 40, and Bc denotes the gloss (shine level) of an image formed on the sheet member P with the other-color toner particles Gc and fixed in the fixing device 40.

Note that Bm>Bc is satisfied by adjusting the mass per unit area of toner on the photoconductor drums 21 by changing the intensity of the exposure light L emitted from the exposure devices 23 shown in FIG. 3, the electric potential of the developing bias to be applied to the developing rollers 242 of the developing devices 24, and the charge amount of toner (charging properties), and thus eventually adjusting the mass, m, per unit area of toner in the toner image before being transferred to the sheet member P.

The mass, m, per unit area of toner in the toner image on the sheet member P may be measured using the above-described measuring method. Furthermore, the gloss of the image on the sheet member P may be measured using a gloss measuring apparatus. In this example, Byk gardner micro-tri-gloss meter-gloss 60° is used.

Concerning the gloss (shine level), Japanese Industrial Standards (JIS) specify that a glass surface, which has a refractive index of 1.567 over the entire visible wavelengths, has a shine level of 100(%). Furthermore, JIS specifies that a reflectance 10% at an angle of incidence of 60° on a glass surface having a refractive index of 1.567 is a shine level of 100(%) and that a reflectance 5% at an angle of incidence of 20° is a shine level of 100(%). According to JIS, the gloss (shine level) is expressed in percentage or by number. Furthermore, basically, the angle of measurement, as well as the manufacturer and type of a measuring apparatus, have to be specified.

Advantages

Next, the operation of the second relevant part configuration will be described.

When an image forming instruction to give metallic shine to at least a portion of an image is issued (in a mode in which the metallic shine is given to at least a portion of an image), the toner-image forming portion 20V corresponding to the metallic color (i.e., an example of a first image forming portion), shown in FIG. 1, is operated.

The sheet member P having the toner image transferred thereto is transported from the transfer nip NT in the transfer device 30 to the fixing nip NF in the fixing device 40 by the intermediate transport portion 58. The fixing device 40 applies heat and pressure to the sheet member P passing through the fixing nip NF. In this way, the toner image transferred to the sheet member P is fixed.

Now, the metallic shine (i.e., the dependence of reflectance on angle) and gloss (shine level) of the metallic-color toner particles Gm will be described. FIGS. 11A to C and 12A to C schematically show toner images formed with the metallic-color toner particles Gm and toner images formed with the other-color toner particles Gc, respectively, fixed to sheet members P. Although the binder resin portions contained in these toner particles are fused together in actuality, they are illustrated in a separate manner in FIGS. 11 and 12 for ease of understanding.

As described above, in order to enhance the metallic shine achieved by the metallic-color toner particles Gm, it is necessary to increase FI shown in FIG. 7; that is, it is necessary to increase the regular reflectance ($L^*_{15°}$) and decrease the diffuse reflectance ($L^*_{110°}$).

Figure 10:
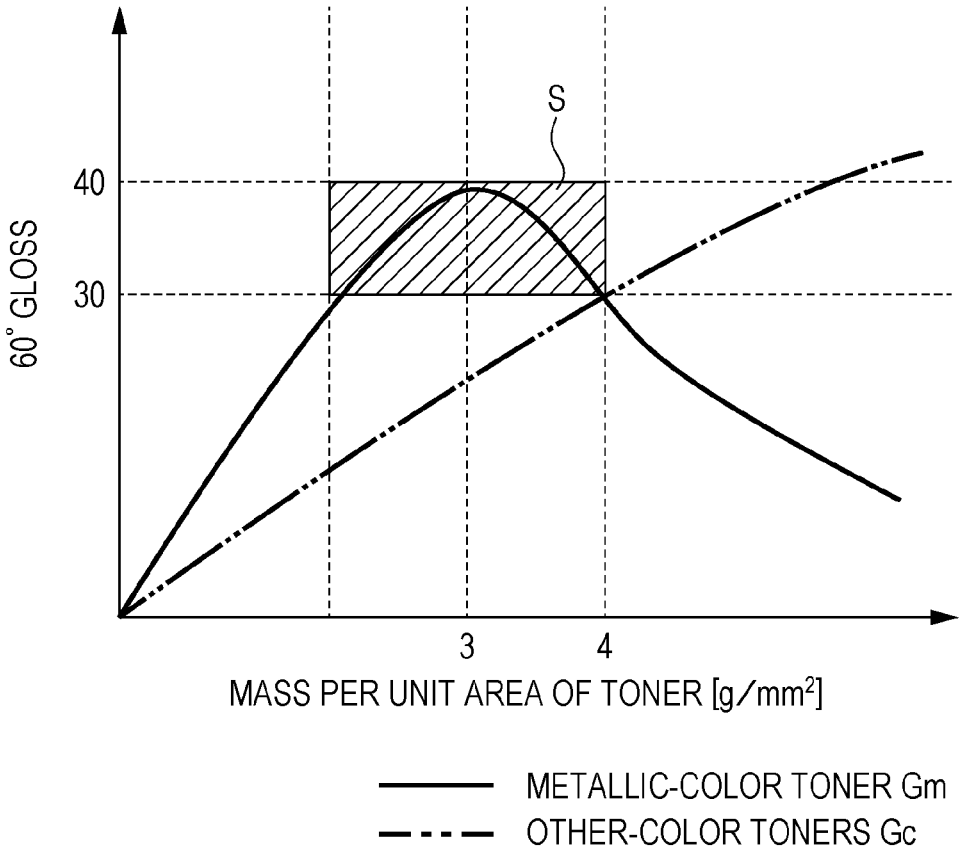
FIG. 10 is a graph showing gloss versus mass per unit area with respect to the metallic-color toner and the other-color toners.
Figure 11A:
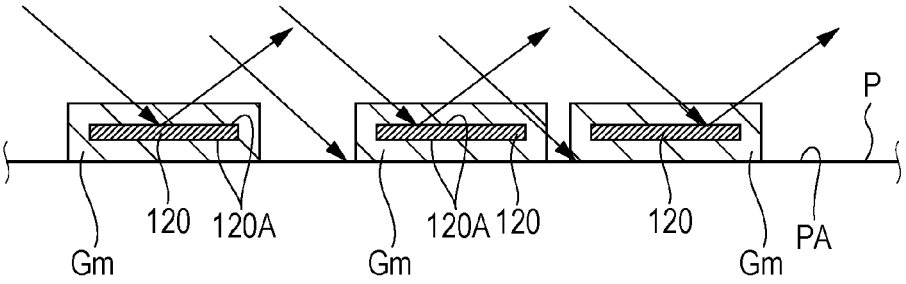
FIG. 11A is a schematic diagram showing that the mass per unit area of the metallic-color toner on a sheet member is small.
Figure 12A:
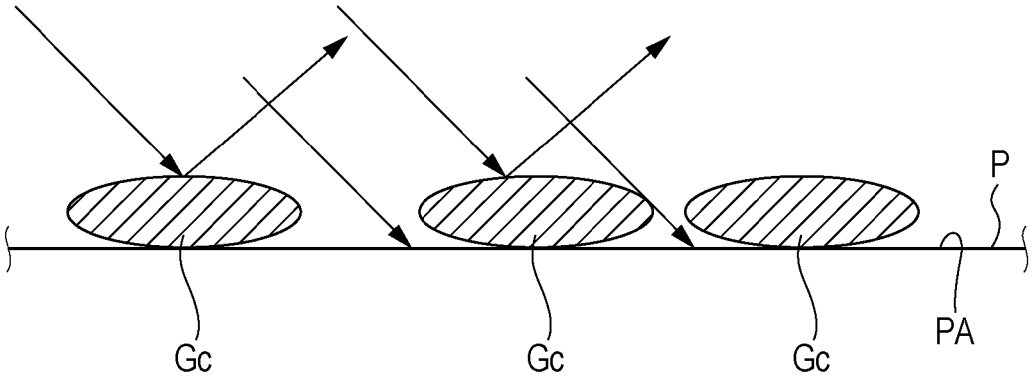
FIG. 12A is a schematic diagram showing that the mass per unit area of the other-color toners on a sheet member is small.

As shown in FIGS. 11A and 12A, when the mass, m, per unit area of toner in a toner image on a sheet member P before fixing is small, there are spaces between the toner particles, and the sheet member P is exposed. Hence, as shown in FIG. 10, the gloss, Bm, of the metallic-color toner particles Gm and the gloss, Bc, of the other-color toner particles Gc are both small. Furthermore, as shown in FIG. 11A, although light is reflected in the same direction, the intensity of reflected light is insufficient due to the spaces between the toner particles. Thus, the metallic shine is not high enough.

Figure 11B:
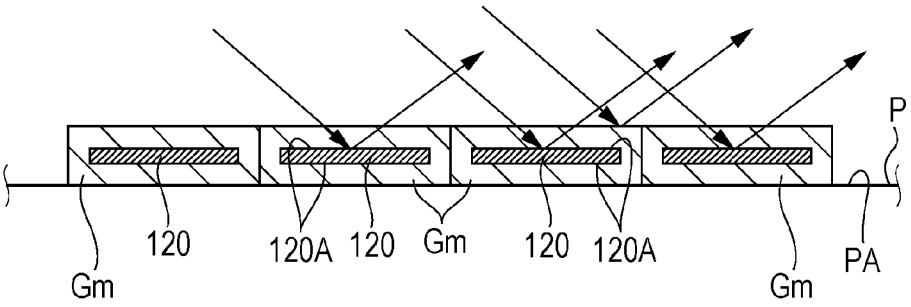
FIG. 11B is a schematic diagram showing that the mass per unit area of the metallic-color toner is larger than that in FIG. 11A.

In the case of the metallic-color toner particles Gm, as shown in FIG. 11B, when the mass, m, per unit area of toner in a toner image on a sheet member P is larger than that shown in FIG. 11A, the reflection surfaces 120A of the flat pigment particles 120 in the metallic-color toner particles Gm have almost an ideal orientation in which they are arrayed, in a single layer, along the plane PA of the sheet member P. As a result, light is reflected in the same direction, increasing the regular reflectance ($L^*_{15°}$) and decreasing the diffuse reflectance ($L^*_{15°}$). Furthermore, there are no spaces between the toner particles, and the intensity of reflected light is sufficient. Thus, the metallic shine is enhanced (FI is high). Furthermore, because the surface is smooth, the gloss increases, as shown in FIG. 10.

Figure 11C:
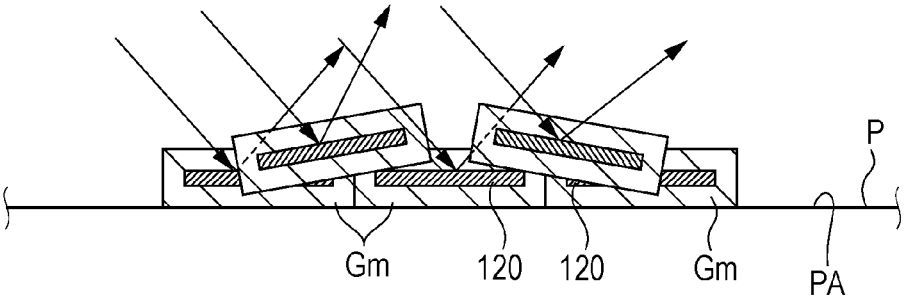
FIG. 11C is a schematic diagram showing that the mass per unit area of the metallic-color toner is larger than that in FIG. 11B.

In the case of the metallic-color toner particles Gm, when the mass, m, per unit area of toner in a toner image on a sheet member P increases even more, as shown in FIG. 11C, the reflection surfaces 120A of the flat pigment particles 120 in the metallic-color toner particles Gm have an orientation in which they face various directions intersecting a direction parallel to the plane PA of the sheet member P. As a result, light is reflected in random directions, decreasing the regular reflectance ($L^*_{15°}$) and increasing the diffuse reflectance ($L^*_{110°}$). Consequently, the metallic shine decreases (FI decreases). Furthermore, because the surface is not smooth, the gloss Bm decreases, as shown in FIG. 10.

Figure 12B:
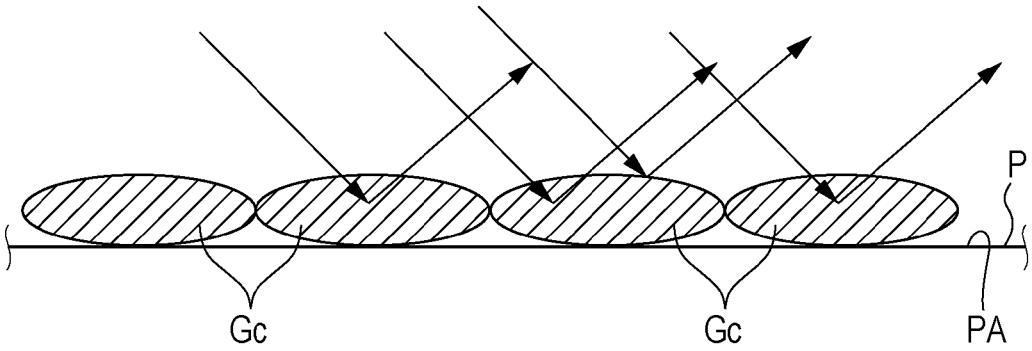
FIG. 12B is a schematic diagram showing that the mass per unit area of the other-color toners is larger than that in FIG. 12A.

In the case of the other-color toner particles Gc, as shown in FIG. 12B, when the mass, m, per unit area of toner in a toner image on a sheet member P increases, the spaces between the toner particles almost disappear. However, because the smoothness of the surface is low, the gloss Bc is not sufficiently high, as shown in FIG. 10.

Figure 12C:
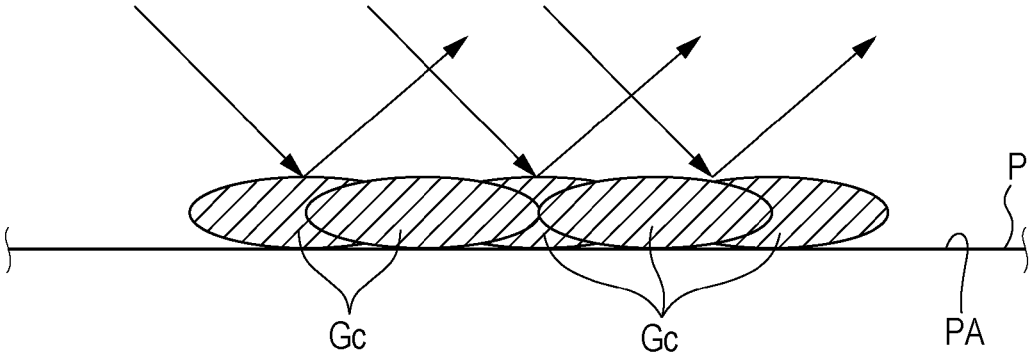
FIG. 12C is a schematic diagram showing that the mass per unit area of the other-color toners is larger than that in FIG. 12B.

In the case of the other-color toner particles Gc, when the mass, m, per unit area of toner in a toner image on a sheet member P increases even more, as shown in FIG. 12C, the spaces between the toner particles disappear, making the surface smooth. Hence, as shown in FIG. 10, the gloss Bc increases.

As has been described above, the gloss of the metallic-color toner particles Gm has a peak relative to the mass, m, per unit area of toner (in the example in FIG. 10, the gloss reaches a peak, i.e., 40, when the mass, m, per unit area of toner is 3 g/mm$^2$), whereas the gloss of the other-color toner particles Gc increases as the mass, m, per unit area of toner increases.

The relationship between Bm and Bc (Bm denotes the gloss (shine level) of an image formed on the sheet member P with the metallic-color toner particles Gm and fixed in the fixing device 40, and Bc denotes the gloss (shine level) of an image formed on the sheet member P with the other-color toner particles Gc and fixed in the fixing device 40) is set to be Bm>Bc; that is, when the mass, m, per unit area of toner shown in FIG. 10 is less than 4 g/mm$^2$, the metallic shine is high (FI is high) (the states shown in FIGS. 11A and 11B). However, when the relationship between Bm and Bc is Bm≤Bc, that is, when the mass, m, per unit area of toner shown in FIG. 10 is larger than or equal to 4 g/mm$^2$, the metallic shine is low (FI is low) (i.e., the state shown in FIG. 11C).

Accordingly, by setting image forming conditions (the intensity of the exposure light L emitted from the exposure devices 23, the electric potential of the developing bias to be applied to the developing rollers 242 of the developing devices 24, the charge amount of toner (charging properties), etc.) such that the gloss (shine level) of the image after being fixed to the sheet member P satisfies Bm>Bc, the metallic shine increases (FI increases).

Note that, in this exemplary embodiment, the mass, m, per unit area of toner in a toner image formed on the sheet member P with the metallic-color toner particles Gm is set such that the gloss is within an area S in FIG. 10 (i.e., a state shown in FIG. 11B); more specifically, the mass, m, per unit area of toner is set to be larger than or equal to 2 g/mm$^2$ and less than 4 g/mm$^2$.

This will be described from a different perspective; that is, by controlling the mass, m, per unit area of toner on a sheet member P (i.e., by setting the image forming conditions) such that the gloss (shine level) of an image formed with the metallic-color toner particles Gm reaches the peak value or a value near the peak, or such that the gloss exceeds a predetermined threshold, a state shown in FIG. 11B (the reflection surfaces 120A of the flat pigment particles 120 in the metallic-color toner particles Gm are in an ideal orientation in which they are arrayed, in a single layer, along a direction parallel to the plane PA of the sheet member P) is achieved, thereby increasing the metallic shine (increasing FI).

Herein, settings of the image forming conditions (the intensity of the exposure light L emitted from the exposure devices 23, the electric potential of the developing bias to be applied to the developing rollers 242 of the developing devices 24, the charge amount of toner (charging properties), etc.) may be different between the metallic-color toner particles Gm and the other-color toner particles Gc. The mass, m, per unit area of toner may also be different between the metallic-color toner particles Gm and the other-color toner particles Gc. For example, the mass, m, per unit area of the metallic-color toner particles Gm may be set to 3 g/mm$^2$, and the mass, m, per unit area of the other-color toner particles Gc may be set to 5 g/mm$^2$.

The present invention is not limited to the above-described exemplary embodiment.

In the first relevant part configuration, the numbers of toner layers, Am and Ac, are set so as to satisfy the relationship Am<Ac, and in the second relevant part configuration, the glosses, Bm and Bc, are set to satisfy Bm>Bc. These conditions may be satisfied either simultaneously or individually. The image forming apparatus also has a mode in which an image is formed without setting these conditions.

Note that, although a specific exemplary embodiment of the present invention has been described in detail above, the present invention is not limited to such an exemplary embodiment, and it is obvious for those skilled in the art that the present invention may have various other exemplary embodiments within a scope of the present invention. For example, in the above-described exemplary embodiment, although a case where toner images of the respective colors are individually transferred to the transfer belt 31 has been described as an example, the toner images of the respective colors may be individually and directly transferred to a sheet member P, or the toner images of the respective colors may be collectively transferred to the transfer belt or the sheet member P.

Furthermore, although a metallic-color toner image and the other-color toner images are simultaneously fixed to a sheet member P in the above-described exemplary embodiment, fixing of the metallic-color toner image onto the sheet member P and fixing of the other-color toner images onto the sheet member P may be performed separately.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first image forming portion configured to use metallic-color toner containing flat pigment having reflection surfaces;

a second image forming portion configured to use toner not containing the flat pigment; and a toner image carrier configured to carry a first toner image that is formed in the first image forming portion and a second toner image that is formed in the second image forming portion, wherein the image forming apparatus has a mode in which a relationship Am<Ac is satisfied, where Am denotes a number of toner layers of the first toner image that is carried by the toner image carrier, and Ac denotes the number of toner layers of the second toner image that is carried by the toner image carrier, wherein the number of toner layers of the first toner image and the second toner image is respectively defined by (m/mt)/(1/S), where m is a mass per unit area of toner, mt is an average mass per toner particle, and S is an average projection area per toner particle, and wherein the number of toner layers of the first toner image is measured at a time when the first toner image is on the toner image carrier and the second toner image is not superimposed on the first toner image on the toner image carrier, wherein the number of toner layers of the second toner image is measured at a time when the second toner image is on the toner image carrier and the first toner image is not superimposed on the second toner image on the toner image carrier, and wherein a gloss of the first toner image has a peak relative to the mass, m, per unit area of toner, whereas a gloss of the second toner image increases as the mass, m, per unit area of toner increases.

2. The image forming apparatus according to claim 1, wherein the first image forming portion and the second image forming portion each include a latent image carrier on which the toner image is formed, and wherein the numbers of toner layers, Am and Ac, are set so as to satisfy the relationship Am<Ac by controlling a mass per unit area of toner in the toner image on each latent image carrier.

3. The image forming apparatus according to claim 2, wherein the first image forming portion and the second image forming portion each include a developing member that develops a latent image formed on the latent image carrier to obtain a toner image, and wherein the mass per unit area of toner in the toner image on the latent image carrier is controlled by changing electric potential of developing bias to be applied to the developing member.

4. The image forming apparatus according to claim 1, wherein the flat pigment in the first toner image is arranged to increase regular reflectance ($L^*_{15°}$) and to decrease diffuse reflectance ($L^*_{110°}$) thereby increasing flop index.

5. The image forming apparatus according to claim 1, wherein the relationship Am<Ac is satisfied by adjusting the mass per unit area of toner in the first and the second toner images on a latent image carrier by changing i) an intensity of an exposure light emitted from an exposure device, ii) an electric potential of a developing bias being applied to a developing member, and iii) a charge amount of toner.

6. The image forming apparatus according to claim 1, wherein the number of toner layers, Am, of the first toner image that is carried by the toner image carrier is set to a value close to one.

7. The image forming apparatus according to claim 1, wherein the reflection surfaces of the metallic-color toner have an orientation in which the reflection surfaces are arrayed parallel to a plane of a recording medium without overlapping one another.

8. The image forming apparatus according to claim 1, wherein the relationship Am <Ac is satisfied by adjusting the mass per unit area of toner in the first and the second toner images on a latent image carrier by changing i) an intensity of an exposure light emitted from an exposure device, ii) an electric potential of a developing bias being applied to a developing member, and iii) a charge amount of toner, and wherein the mass per unit area of toner in the first and the second toner images on a latent image carrier are set to be less than or equal to an amount where the gloss of the first toner image and the gloss of the second toner image are equal.

9. An image forming apparatus comprising:

a first image forming portion configured to use metallic-color toner containing flat pigment with reflection surfaces;

a second image forming portion configured to use toner not containing the flat pigment; and a fixing portion that fixes, onto a recording medium, a first toner image that is formed in the first image forming portion and a second toner image that is formed in the second image forming portion, wherein the image forming apparatus has a mode in which a relationship Bm>Bc is satisfied, where Bm denotes an amount of a gloss of the first toner image that is fixed to the recording medium in the fixing portion, and Bc denotes an amount of a gloss of the second toner image that is fixed to the recording medium in the fixing portion, and wherein the gloss of the first toner image has a peak relative to the mass, m, per unit area of toner, whereas the gloss of the second toner image increases as the mass, in, per unit area of toner increase.

10. The image forming apparatus according to claim 9, wherein the glosses, Bm and Bc, are set so as to satisfy the relationship Bm>Bc by controlling a mass per unit area of toner in the toner images on the recording medium.

11. The image forming apparatus according to claim 9, wherein the flat pigment in the first toner image is arranged to increase regular reflectance ($L^*_{15°}$) and to decrease diffuse reflectance ($L^*_{110°}$) thereby increasing flop index.

12. The image forming apparatus according to claim 9, wherein the relationship Bm>Bc is satisfied by adjusting the mass per unit area of toner in the first and the second toner images on a latent image carrier by changing i) an intensity of a exposure light emitted from an exposure device, ii) an electric potential of a developing bias being applied to a developing member, and iii) a charge amount of toner.

13. The image forming apparatus according to claim 9, wherein the glosses, Bm and Bc, are set so as to satisfy the relationship Bm>Bc by controlling a mass per unit area of toner in the toner images on the recording medium such that the gloss of an image formed with the metallic-color toner particles reaches the peak value or a value near the peak value or such that the gloss exceeds a predetermined threshold.

14. The image forming apparatus according to claim 9, wherein the relationship Bm>Bc is satisfied by adjusting the mass per unit area of toner in the first and the second toner images on a latent image carrier by changing i) an intensity of a exposure light emitted from an exposure device, ii) an electric potential of a developing bias being applied to a developing member, and iii) a charge amount of toner, wherein the mass per unit area of toner in the first and the second toner images on a latent image carrier are set to be less than or equal to an amount where the gloss of the first toner image and the gloss of the second toner image are equal.

* * * * *